US005352093A

United States Patent [19]

Hannon et al.

[11] Patent Number: 5,352,093

[45] Date of Patent: Oct. 4, 1994

[54] WEEDLESS PROPELLER

[76] Inventors: R. Douglas Hannon; George E. Lackman, both of c/o First Union National Bank of Florida, 100 S. Ashley Dr., Suite 1000, Tampa, Fla. 33602

[21] Appl. No.: 855,529

[22] Filed: Mar. 23, 1992

Related U.S. Application Data

[63] Continuation-in-part of Ser. No. 384,507, Jul. 24, 1989, abandoned.

[51] Int. Cl.[5] ..... B63H 1/20

[52] U.S. Cl. ..... 416/234; 416/93 A; 416/244 B

[58] Field of Search ..... 416/93 A, 93 M, 146 B, 416/245 A, 245 B, 244, 242, 202, 234

[56] References Cited

U.S. PATENT DOCUMENTS

| | | | |
|---|---|---|---|
| 552,938 | 1/1896 | Viert . | |
| 645,354 | 3/1900 | Emrich . | |
| 890,973 | 6/1908 | Filippi . | |
| 1,136,098 | 4/1915 | Campbell . | |
| 1,797,068 | 3/1935 | Bocksruker . | |
| 2,068,792 | 1/1937 | Dekker . | |
| 3,081,826 | 3/1963 | Loiseau . | |
| 3,367,423 | 2/1968 | Van Ranst | 416/93 A |
| 4,482,298 | 11/1984 | Hannon et al. | 416/234 |
| 4,676,758 | 6/1987 | Dennis . | |
| 4,775,297 | 10/1988 | Bernauer . | |

FOREIGN PATENT DOCUMENTS

| | | |
|---|---|---|
| 500266 | 5/1930 | Fed. Rep. of Germany . |
| 2013481 | 10/1970 | Fed. Rep. of Germany . |
| 433064 | 1/1971 | U.S.S.R. . |
| 2201198 | 8/1988 | United Kingdom . |

*Primary Examiner*—John T. Kwon

*Attorney, Agent, or Firm*—Wood, Phillips, VanSanten, Hoffman & Ertel

[57] ABSTRACT

A propeller for use on low power motors, such as two-horsepower or less electric trolling motors, is provided with three or more blades on a hub wherein the hub diameter to the blade length (i.e. the length of the blade from the hub to the outermost tip) is in the ratio of at least 1.250 to 1. The hub diameter to blade length ration is such as to produce a propeller having increased performance and is substantially weedless. The width of each blade at its root is equal to or greater than the blade length and the ratio of the sum of the widths of the blades to the circumference of the hub is approximately 1.2 to 1. The true or actual pitch of the blades is measured at 0.7 the radius of the propeller and produces the best results as far as performance and weedlessness is concerned within the range of 2" to 7". The leading edge of one blade forms a junction with the hub in close proximity to a plane containing both the longitudinal axis of the hub and the junction of the trailing edge of the next adjacent blade. The improved weedlessness obtained by this last named structure, namely, locating the junction of the leading edge of one blade either in the same plane or in close proximity to the plane containing the longitudinal axis of the hub and the junction of the trailing edge of the next adjacent blade is effective with two or more blades.

19 Claims, 4 Drawing Sheets

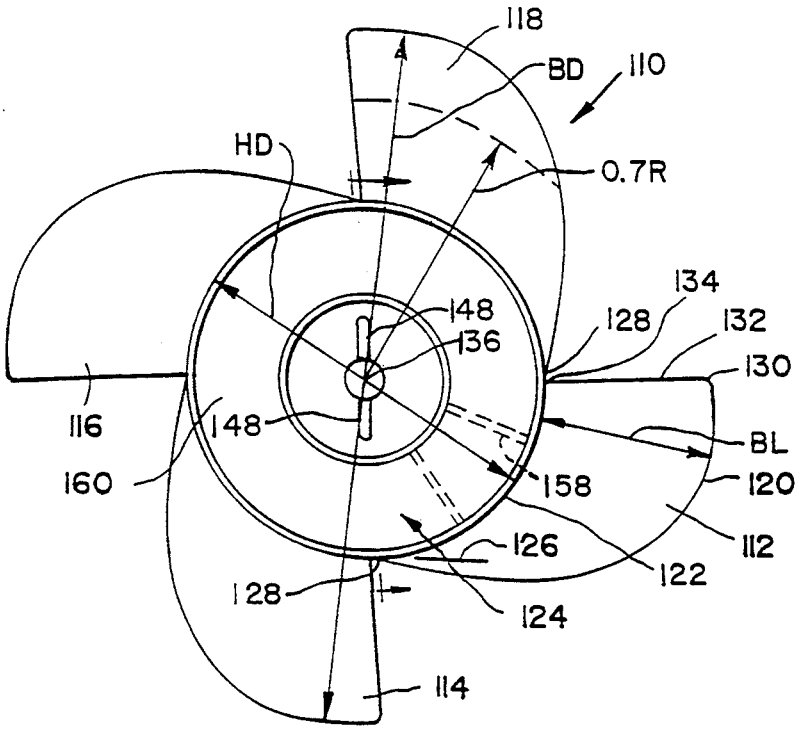
Fig. 9
Fig. 10
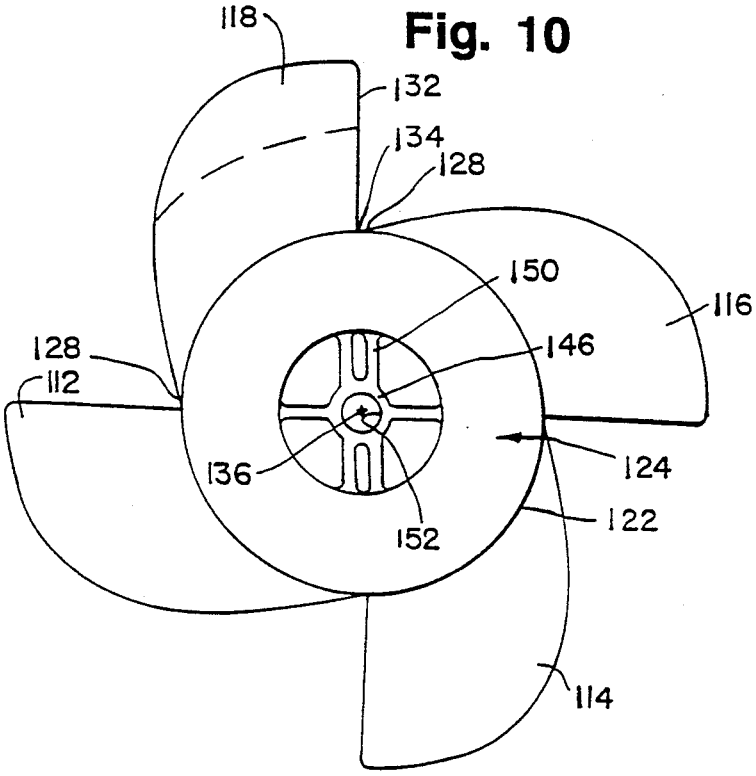
Fig. 11
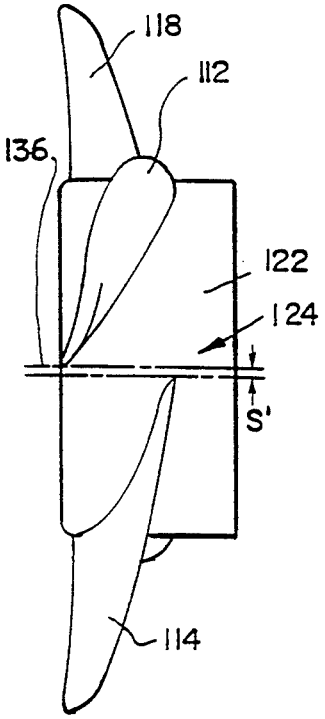

WEEDLESS PROPELLER

CROSS REFERENCE

This application is a continuation in part application of copending application Ser. No. 384,507 filed Jul. 24, 1989, now abandoned.

BACKGROUND OF THE INVENTION

This invention relates to improved propellers for operating in fluid with a weed-infested environment and, in particular, to an electric motor driven propeller that produces a high thrust and is substantially weedfree in operation.

Background Art

Propellers of the type contemplated by this application are for use on trolling motors and the like. Trolling motors are, for the purpose of this application, small, waterproof, fractional horsepower, i.e. under two horsepower, electric motors used for trolling or positioning a fishing boat. These small electric motors are fitted with a marine propeller and submerged under water. A waterproof hollow tube is attached to the motor housing. This hollow tube passes through a bracket or fixture which is attached to the fishing boat. The interface between the bracket and the hollow tube is constructed such that it will allow rotation of the hollow tube, thus directing the thrust of the motor/-propeller. This directioning of the thrust, or steering, controls the movement of the fishing boat. Controlling the movement of the fishing boat is the purpose of the trolling motor.

Prior to the invention described and claimed in the Harmon and Lackman's prior issued U.S. Pat. No. 4,482,298 these existed some structures intended to be operated in a weed-infested environment. However, none of the prior known propellers was successful in continuous operation not only in starting up in a heavily weeded area but also in continuing to operate in that area. This was particularly true using relatively low speed motors. It is generally recognized that any propeller operating at high speed will more than likely power its way through a weed patch, although it may have difficulty starting in such a weed patch.

With the advent of the invention disclosed in our issued U.S. Pat. No. 4,428,298, propellers for smaller motors operating at relatively slow speeds were, for the first time, successful in starting and operating in heavily weeded areas. However, time and experience working with the inventive propeller revealed that, under certain extreme conditions, certain isolated problems became apparent. These conditions revealed that the propeller, during start-up in an extreme weedy surrounding sometimes became fouled before sufficient speed of the motor had been produced. That is, the standing weeds became entangled around the propeller and hub before the propeller could reaeh a speed sufficient to propel the weeds through the propeller and start the boat moving through the weeds and water.

In addition, the commercial forms of the patented propeller, as manufactured and sold under license by MotorGuide Division of Zebco Corporation, a Brunswick Company, used only two blades, which normally is considered an efficient structure, created sudden instability which made it more difficult to steer and tended to stress the steering apparatus and loosen the brackets that are used for mounting the motor on the boat.

It was also found that, under certain operating conditions, for instance, extremely thick and long weeds, the two-bladed propeller would tend to become entangled at startup and at slow or low speed operation.

With the blades of the propeller curved in the direction of rotation of the blade, that is curved from the leading edge to the trailing edge, and with long blade lengths, turbulence was created by the blades and cavitation resulted along the radially extreme portions of the blades. The two-bladed propellers, because of the low blade area ratio (total blade area as a percent of the total swept area), produced a resonance at the hub which added vibrations to the propeller and increased the noise of operation of the propeller. The two-bladed propellers, in order to get some increased performance, were relatively long, having a blade length to hub diameter ratio of close to one. The large propeller diameter resulted in faster tip speed which can, and occasionally did, cause increased turbulence, cavitation and noise. The increased turbulence breaks up the smooth flow of weeds through the blade, which can contribute to the weeds becoming entangled in the propeller. The increased blade length exposed more blade surface to more weeds, which inadvertently can result in the weeds becoming entangled in the propeller. The large diameter propeller had a higher tip speed which can cause turbulence, cavitation, and increased noise.

The two-bladed propellers have been found to Dull weeds into their sphere of influence from a space radially outward of the blade tips. As the weeds are pulled radially inward toward the hub, the weeds become more compacted and, as the weeds strike each other with a radially inward component, their flow path is disturbed, thereby contributing to the weeds becoming entangled around the blades of the propeller.

Three and four bladed propellers without certain parameters have become fouled with weeds when the blade lengths to blade diameter ratio is outside certain limits and when the peripheral gap between successive blades at the hub is to large.

The above enumerated problems have been addressed and have been solved by the hereinafter disclosed structure.

SUMMARY OF THE INVENTION

The present invention avoids the problems enumerated with respect to the prior structures and further improves electric motor-driven propellers of the type shown, described and claimed in U.S. Pat. No. 4,482,298, issued to the common Joint inventors of the present structure. Specifically, it has been discovered that three or more blades, preferably four blades, each having a substantially planar configuration with a root width at the hub surface greater than or equal to the blade length will produce a propeller having increased performance that will be substantially weedless. The preferred ratio of hub diameter to blade length will be in the general range of greater than 1.25 to 1, with the resulting blade length being shorter than heretofore, whereby resonance at the hub is reduced, flexing of the blades is reduced, steering instability is reduced, cavitation and blade deflection are reduced and, most important, weedlessness is improved, in particular, at start-up in heavily weeded areas and at slow as well as fast running conditions in heavily weeded areas.

The substantially planar configuration of the blades, the high blade area ratio as defined herein, and the relatively high ratio of the hub diameter to blade length (greater than i.e. 1.25-to-1) moves the weeds and water through the working area of the propeller from radially spaced locations and without creating undue turbulence in zones radially spaced form the blade tips.

The reduced propeller diameters with the resulting reduced turbulence makes it possible to operate the propeller, and thus, the boat, in shallow environments without losing power, without creating undue steering instability and stress on the motor suspension or motor mount, and without creating surface cavitation on the blades.

By increasing the number of blades to three, four or more, it was found that the blade length could be reduced, the working blade surfaces could be increased, and the pitch of the blades could be increased, resulting in reduced tip speed (typically, in one example, reduced form 55 to 44 feet per second), and since the blades are shorter, there are less weeds to be encountered as the propeller passes through the reduced area contacted by the shorter blades.

The trailing edge of one blade lies in a plane parallel to the longitudinal axis of the hub, which plane intersects the surface of the hub along an axial line which passes through or in close proximity to the point where the leading edge of the immediately adjacent blade joins the hub, whereby, upon rotating the propeller, turbulence is reduced at the surface of the hub and there are substantially no areas on the propeller where weeds can start to gather and/or hang up.

It has been discovered that the structural concepts of our invention work equally well with two blades when the width of each blade at the hub is equal to or greater than the blade length and when the junction at the hub of the leading edge of one blade lies in a plane containing the longitudinal axis of the propeller and which plane either contains the junction at the hub of the trailing edge of the next adjacent blade or said junction of the trailing edge at the hub lies in close proximity on either side of said plane.

The swept-back leading edge of each blade intersects the straight trailing edge at a trailing corner for each blade and creates a blade shape which has no radial overhanging surfaces so that weeds that do momentarily double back around the leading edge of a blade will slide outward or be pushed radially outward and along the swept-back edge until they disengage from the blade and flow rearward away from the propeller. This phenomenon is true even when the propeller is first rotated in a weed-loaded environment, that is, as the blades start to rotate among the weeds, they will initially engage some weeds which will lay doubled back across the leading edge of the blades. As the blade picks up speed, the forces acting on the swept-back leading edges of the blades will sling or push or throw the weeds radially along the leading edge until they disengage from the blades and flow rearward away from the propeller.

BRIEF DESCRIPTION OF THE DRAWING

These and other features and advantages of the invention will be apparent from the following description taken in connection with the accompanying drawing wherein:

FIG. 9 is a front elevational view of a modified form of a propeller, looking from the front toward the rear of the propeller;

FIG. 10 is a rear elevational view of the propeller of FIG. 9;

FIG. 11 is a side elevational view of the propeller of FIG. 9;

DESCRIPTION OF THE PREFERRED EMBODIMENT

Figure 1:
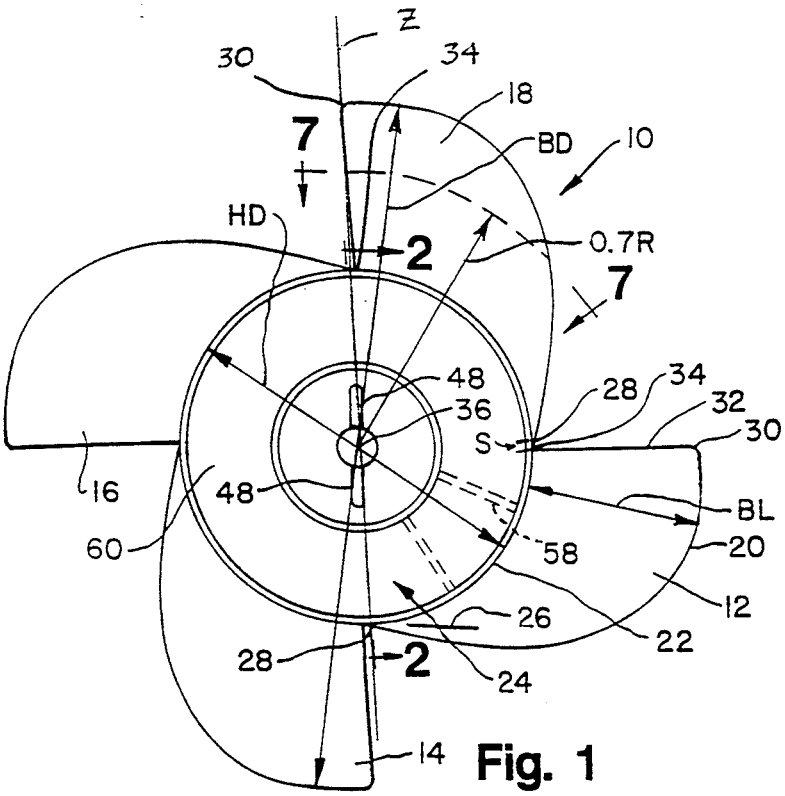
FIG. 1 is a front elevational view of a propeller incorporating the invention, looking from the front toward the rear of the propeller when mounted on a trolling motor as shown in FIG. 8.

Referring to FIGS. 1–8 of the drawings, one preferred form of propeller 10 is illustrated for the purpose of describing the broad improvement resulting from the structural modifications made to our earlier patented propeller set out in detail in U.S. Pat. No. 4,482,298, issued Nov. 13, 1984. In particular, it has been discovered with respect to this modification that three or more blades, and preferably four blades 12,14, 16 and 18, provide better overall dynamic balance to the propeller reducing steering instability on the motor, motor mount and on the boat. Each blade, i.e. blade 12, has a leading edge 20 swept back in the direction opposite to the direction of rotation of the blade and is joined with a surface 22 of a tubular-shaped hub 24 along a line 26 that approaches a tangent to the hub. That is, the leading edge 20 contacts the hub at a junction or point 28 which may be tangent or may be a few degrees on either side of a tangent, the intent being to minimize sharp or severe changes in direction either along the surface 22 of the hub 24 or between the hub and the leading edge of the blade. The leading edge 20 of the blade, as it sweeps back, intersects at a corner 30 with a straight trailing edge 32 which trailing edge joins the surface 22 of the hub 24 at a junction or point 34. The trailing edge 32 and point 34 lie in a first plane that is parallel to the longitudinal axis 36 of the hub and said first plane intersects the hub surface 22 along a line 38 (FIG. 5) containing point 34 and lying parallel with the longitudinal axis 36. The first plane is displaced from the longitudinal axis 36 on the side of the longitudinal axis containing the blade 12. The same relationship exists between the trailing edge of each blade 12, 14, 16, 18 and the longitudinal axis 36.

Trolling motors are low horsepower electric or gas driven motors, usually with under two horsepower output, and are driven in one direction only (clockwise). The leading edge 20 of the blades of the propeller would be the edge that would first engage the water and the weeds when the trolling motor rotates in its normal clockwise unidirectional direction.

Each blade 12, 14, 16, and 18 has a width W (FIG. 5) where the blade Joints with the hub. The width is illustrated as a line W in FIG. 5 extending from point 28 where the leading edge intersects the hub angularly across and rearward on the surface of the hub to the junction point 34 where the trailing edge of the blade joins the hub. The pitch of the propeller is recognized as the axial distance the propeller will travel in a solid mass (no slippage) during one full revolution of the propeller. The deadfall A, or the distance from the plane containing a point at the leading edge, i.e. 28, and intersecting the axis 36 at right angles and the corresponding point on the trailing edge, i.e. point 34, is one element used in determining the pitch of the blade at the blade root. The compute the pitch, the deadfall A is multiplied by the value of 360° divided by the angle B (the angle subscribed by the blade width, see FIG. 5). In the example of FIGS. 1–3 and 5, the angle B of the blade is approximately 45°, and the deadfall A is 0.5 inches, therefore $360/45 \times 0.5 = 4''$ is the pitch at the root of the blade.

In designing the true pitch of the blades, it has become standard in the propeller art to measure the pitch on a circle having a radius equal to seven-tenths of the radius (0.7 R) of the propeller. Blades are known to have one pitch at the roots, which pitch varies and flattens as one moves from the root to the tip, with the angle being less at the tip. The higher or greater pitch has been found to be more weedless. Measuring the pitch at 0.7 R gives a good average pitch upon which the blade can be rated. The pitch is calculated using the formula as set forth herein above, which has been found, in the case of the present propeller, to be in the range of 2" to 7" to produce the best combination of performance and weedlessness.

Figure 2:
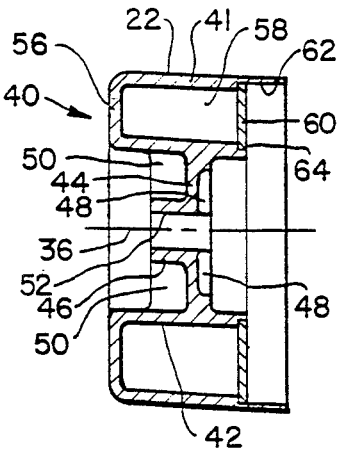
FIG. 2 is a cross-sectional view of the hub of the propeller taken along the line 2—2 of FIG. 1 with the blades not shown.
Figure 3:
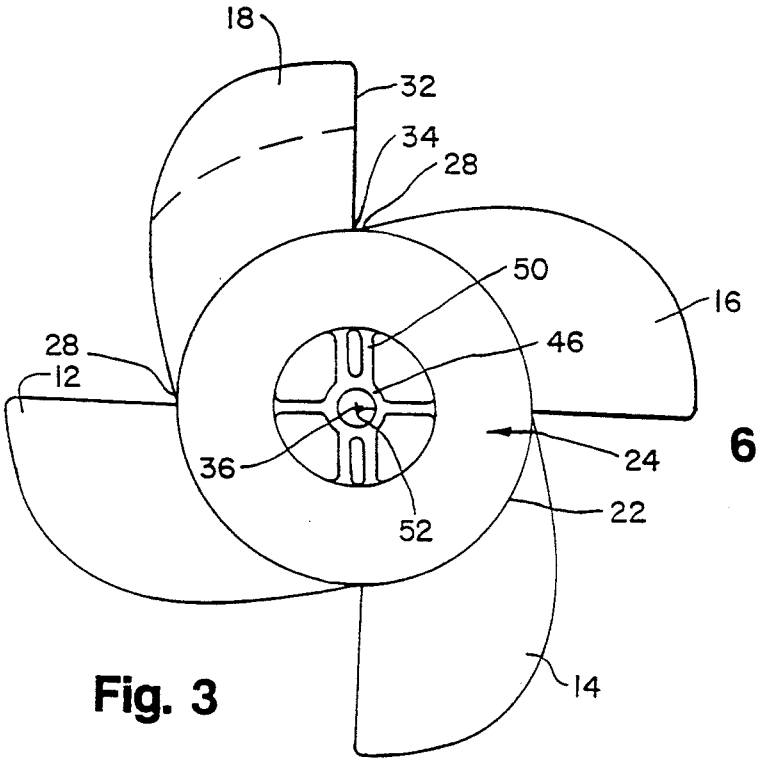
FIG. 3 is a rear elevational view of the propeller of FIG. 1.

The propeller 10 has the hub 24, as shown in cross section in FIG. 2, with the cylindrical surface 22 being the outer surface of a wall 41 of a donut-shaped ring or segment 40 having an inner wall 42 to which is joined a web 44 supporting a mounting sleeve 46. A pair of aligned, radially disposed slots 48 (FIGS. 1 and 2) are formed in one face of the web 44. Ribs 50 (FIGS. 2 and 3) support the sleeve 46, which sleeve has an opening 52 and an axis coinciding with and forming the longitudinal axis 36 of the hub, the blades and the propeller. The propeller is assembled with a drive shaft 53 of a trolling motor 55 (FIG. 8) by sliding the sleeve 46 onto the drive shaft 53 so that a cross pin 57 on the drive shaft nests in slots 48, whereupon a nut 49 is threaded onto the end of the shaft to bear against the end of the sleeve 46. The donut-shaped ring 40 has an integrally formed, axially facing rear wall 56 and a plurality of internal radial ribs 58 extending between wall 41 and wall 42. A front wall 60 is fastened in undercut grooves 62, 64 in the walls 41 and 42, respectively, to close the chambers in the donut-shaped ring 40. The undercut groove 62 extends axially beyond the wall 60 so as to overlap with a rear portion of the housing 66 of trolling motor 55.

The trolling motor 55 is a conventional electric trolling motor described briefly in the beginning of the background art hereinabove and includes a control rod 68 through which control wires and the like pass to a motor mounted in the housing 66. A typical trolling motor is manufactured and sold by MotorGuide Division of Zebco Corporation under the trademark "MotorGuide".

In our prior U.S. Pat. No. 4,482,298, the hub diameter (HD), blade diameter (BD) and blade length (BL) were defined and, for the purposes of the present description, the hub diameter (HD) is the diameter of the hub 24 measured at the midpoint of the width W of the blade. This measurement takes into consideration that some hubs taper front to rear so that by measuring the hub diameter at the midpoint of the blade, the hub diameter is clearly established. The blade diameter (BD) will hereinafter be referred to as the propeller diameter (BD) and is the diameter of the circle subscribed by rotating the outermost point of the blade about the axis 36 of the hub. The blade length (BL) is defined as the difference between the propeller diameter (BD) and the hub diameter (HD) divided by two $$\left(BL = \frac{BD - HD}{2}\right).$$

The relationship between the hub diameter and the blade length was pointed out in our U.S. Pat. No. 4,482,298 as important. The ratio established in our patent was that the hub diameter was at least as great as the blade length (i.e., HD equal to or greater than BL). Commercial blades made under the patent generally have maintained the relationship as having the hub diameter substantially equal to the blade length.

It has been discovered that in some embodiments of our invention increasing the number of blades to three or more, maintaining the hub diameter approximately the same (due in part to the fact that the diameter of trolling motor housings have not changed) and shortening the blade length (BL) has produced new and unexpected results.

In one preferred form shown, the number of blades has been increased to four blades (12, 14, 16, 18), and the blade length has been shortened to approximately one-half the hub diameter, resulting in surprisingly improved performance. In fact, a four-bladed propeller with a blade length equal to approximately one-half the hub diameter and with the blade width (W) equal to or greater than the blade length, the weedlessness both at startup and during all phases of operation was exceptional, cavitation was eliminated, operation was quieter and steering instability was materially reduced.

The improved results are believed to be due to a combination of changes to the basic weedless propeller disclosed in U.S. Pat. No. 4,482,298. The blade length has been reduced, thereby reducing the speed of the blade tips which, in turn, reduces the possibility of cavitation, reduced noise and reduced blade flexing. The shorter blades permit the propeller to be run in shallower water and closer to the surface. Employing three or more blades better balances the forces acting on the motor resulting on more uniform operation, including less steering instability and strain on the motor mounts, making steering and control of the motor easier. Maintaining the ratio of the blade length to the hub diameter from 1 to 1.25 and above and preferably from 1 to 1.25 to 1 to 2 contributes further to the reduced cavitation, reduces noise and reduced blade flexing. Using three or more blades and increasing the blade widths (at the hub) and maintaining a relatively high pitch improves the weedlessness. In fact, having three or more blades, with the blade widths equal to or slightly greater than the blade lengths, holds the water and weeds to a tubular shaped envelope creating less turbulence in the surrounding weeds and water and moving the weeds through the rotating blades without catching the weeds on the blades. In addition, using three or more blades with the substantially 1.25 to 1 up to 2 and 1 hub diameter to blade length ratio and the substantially 1 to 1 blade width to blade length ratio provides a relatively high blade area ratio, all of which contribute to the weedlessness.

In the marine propeller art, it has become accepted practice to compute the blade area ratio which is expressed as a percent. The blade area ratio is defined as the total blade area as a percent of the total swept area. It has been found that the best weedlessness results from a three or more bladed propeller having the hub diameter to blade length ratio in the range between 1.25 to 1 and 2 to 1, and having the blade width equal to or greater than the blade length, has a blade area ratio in the range of 50% to 65%. The farther above the 65% blade area ratio one goes there is too much blade coverage and the advantages of the propeller diminish. Likewise, as one goes below the 50% blade area ratio, the blades are too far apart or there is too much open area, resulting in the weedlessness diminishing.

As an example, the four-blade propeller shown in the drawings, when made with a hub diameter equal to 3 ½", the hub diameter to blade length ratio is approximately 2 to 1, the blade width (W) is slightly longer than the blade length, and the ratio of the sum of the blade widths to the circumference of the hub is 1.2 to 1, has a total blade area of 24.50 sq. in. and a total swept area of 38.29 sq. in., resulting in a blade area ratio of 63.99%. A second example is a four-bladed propeller having a 2 ¾" diameter hub (for use on a 3" diameter motor housing) has a hub diameter to blade length ratio of approximately 1,375 to 1, the blade width (W) to blade length ratio of 1 to 1, and the ratio of the sum of the blade width to the circumference of the hub of 1.2 to 1 has a total blade area of 20.58 sq. in. and a total swept area of 36.53 sq. in. which produces a blade area ratio of 56.33%.

It has been found that maintaining the distance S between the junction with the hub of the leading edge of one blade close to the plane containing the longitudinal axis of the propeller and the contact point of the trailing edge of the immediately preceding blade, weedlessness is improved. As an example, the space between point 28 and point 34 in the front view of FIG. 1 is a typical distance S. The distance S can vary from roughly 8° that shown in FIG. 1 to 0° where the points 28, 34 line up axially to where the points overlap in the direction opposite to that shown in FIG. 1. There are different explanations for why this spacing creates weedlessness. One explanation being that, between adjacent blades, there is little or no space on the hub surface and little or no discontinuity between the hub surface and the leading edge of each blade so that there is no place where weeds can hang up and build up on the propeller.

Another explanation being that one blade moves the water, which water moves the weeds and water past that blade where the next blade picks up the weeds and water and moves them past the blade and so on. There is a smooth transition from blade to blade somewhat like runners passing a baton in a relay race. Regardless of what theory is used to explain the process, the fact is that the propeller with the leading and trailing edges of successive blades in close axially longitudinal alignment is substantially weedless both at startup in a weedy environment and in operation in a weedy environment.

Figure 7:
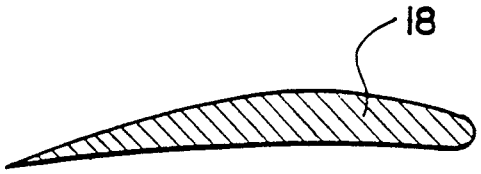
FIG. 7 is a cross-sectional view of a blade taken along the line 7—7 of FIG. 1.
Figure 8:
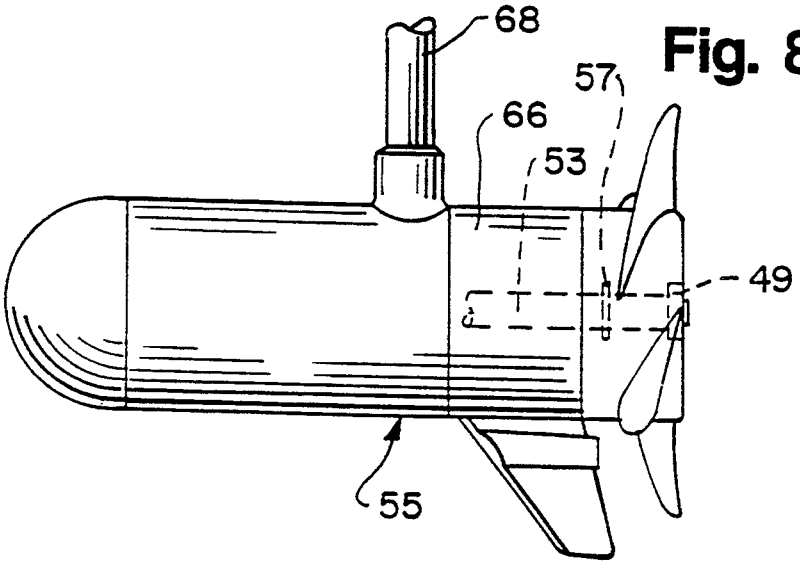
FIG. 8 is a side elevational view of an electric trolling motor having the inventive propeller attached thereto.

The blade cross section, from its root where the blade width is illustrated as W (FIG. 5), has a very slight curve or foil effect and a particular relatively high pitch, which cross-sectional shape varies only slightly as one moves radially outward along the blade. That is, the cross-sectional shape remains the same, as the cross-sectional area decreases, the pitch remains substantially the same, and the surfaces flatten. The pitch remains relatively high as one moves outward on the blade. FIG. 7 illustrates the blade cross section taken at 0.7 of the radius of the propeller, which cross-sectional shape is a hydrofoil shape and the same as at the blade root, but the cross-sectional area is decreased. Ideally, a propeller needs one pitch on the blade for startup and a different pitch at running speeds. It is known that plastic blades flex under load. By reducing the blade length and designing the blade, taking advantage of the flex characteristics of the blade material, will produce a blade having an ideal relatively high pitch at startup, which blade will flex to a reduced pitch as the blade is loaded in building up speed and will unload at normal operating speeds to deflect back to the greater pitch for more speed, thereby taking advantage of both ideal conditions.

It is believed that what constitutes cavitation and blowout are well-known in the art. In the present case, due in part to the shorter blade length and large hub diameter, cavitation and blowout are avoided. The shorter, more numerous blades make it possible to reduce tip speed on the blades without sacrificing overall performance and, in fact, the propellers can be operated at an increased RAM giving better overall performance, without cavitation, blowout, or without becoming fouled with weeds. Specifically, in our prior patent, it was recognized that improved results were obtained by maintaining the hub diameter at least as great as the blade length, or stated another way, the hub diameter must be equal to or greater than the blade length. It has now been recognized that the ratio of hub diameter to blade length should be 1.250 to 1 or greater, and since there are only a few standard hub diameters, for instance, at the present time, from 2" to 4" in roughly ½" steps, the hub diameter is a reasonably fixed size while the blade lengths are shortened to within the 1.250 to 1 up to 2 to 1 and above range. The more limited ratio of blade length to hub diameter, in addition to the use of three or more blades, the relatively high blade area ratio of total blade area to total swept area, the ratio of blade width being equal to or greater than the blade length, and the ratio of total blade widths to hub circumference equaling about 1.2 to 1, produces a propeller that moves the water and weeds through the propeller in a generally tubular envelope, whereby cavitation is eliminated, blowout is avoided, no weeds are caught up on the blades, turbulence is reduced and noise is substantially reduced. Various combinations of the five elements just enumerated produce improved results with, for example, a great improvement coming from a 3 ½" diameter hub having a four-bladed propeller with a hub diameter to blade length ratio of 2 to 1, having a blade area ratio of 64%, and having a blade width substantially equal to the blade length and having the sum total of the blade widths (at the blade roots) to the hub circumference equal to 1.2 to 1. A second four-bladed propeller producing exceptional results has a 2 ¾" hub diameter with a hub diameter to blade length ratio of 1.375 to 1, having a blade area ratio of 56%, having a blade width substantially equal to the blade length and having the sum of the four blade widths equal to approximately 1.2 to 1.

Figure 4:
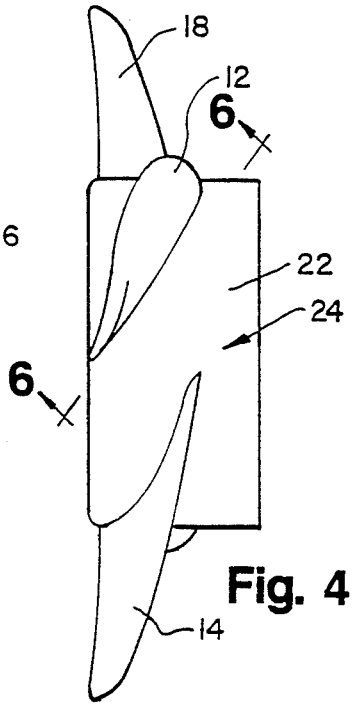
FIG. 4 is a side elevational view of the propeller of FIG. 1.
Figure 6:
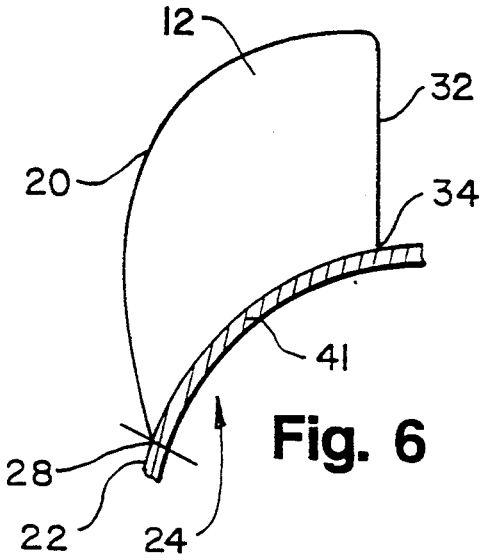
FIG. 6 is a front view of a blade of FIG. 1 taken along the line 6—6 of FIG. 4.
Figure 5:
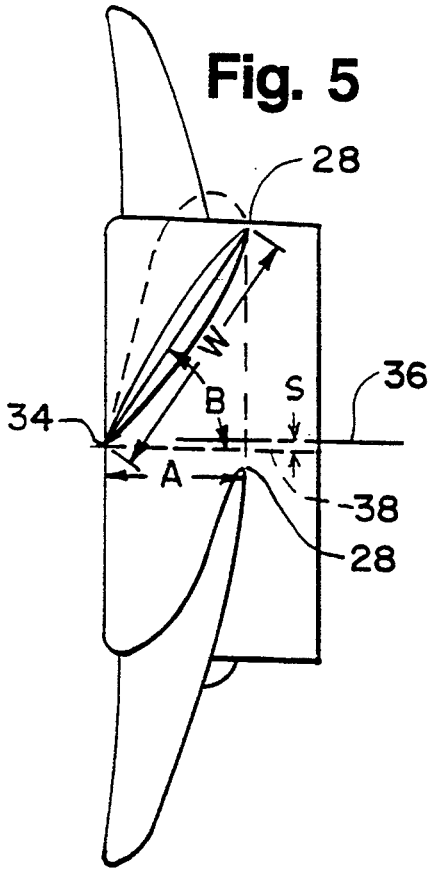
FIG. 5 is a schematic side view of the hub with the line of attachment or width of one of the blades to the hub illustrated.

FIG. 6 illustrates the actual size of a blade 12 viewed from a plane parallel to the face of the blade and taken along line 6—6 of FIG. 4. This view illustrates the apparent foreshortening of the blades when viewed from the front of the propeller. The sum of the widths of the blades, due to the added length created by the angle of the blade on the hub when compared to the circumference of the hub has been found to be equal to a ratio of 1.2 to 1 plus or minus a small amount (i.e. 1 to 1 or 1.4 to 1).

One modified version of our weedless propeller is shown in FIGS. 9, 10 and 11 wherein all elements of the propeller described with respect to FIGS. 1–8 are shown and are numbered the same except that the numeral 1 has been added in front of each number. Thus, the propeller 110 is shown as comprising a hub 124 and having blades 112, 114, 116 and 118 with each blade having a leading edge 120 intersecting the hub at a point 128 and a trailing edge intersecting the hub at a point 134.

The principal difference between the form of the invention shown in FIGS. 1–8 and FIGS. 9–11 is in the size of the gap s' which is the distance between the plane containing the junction 128 of the leading edge 120 of one blade and the longitudinal axis of the propeller and the junction 134 of the trailing edge 132 of the next adjacent blade. In the version shown in FIGS. 1 to 8 the gap S is approximately 5° while in FIGS. 9–11 the gap S' is approximately 0° to 1°. With respect to FIGS. 1–8 the gap S can vary from approximately 8° to 0° or to an overlapping condition. Weedlessness is enhanced when the size of the gap S and S' varies from approximately 8° to an overlapping condition between the junction of the leading edge 128 of one blade and the junction of the trailing edge 134 of the adjacent blade. As the propeller starts up in weed infested water or is driven into weed infested water the weeds have no straight axially longitudinal surface on the hub that they can cling to or stick to. That is, in prior propellers where there was a substantial gap between on the one hand the plane containing not only the junction of the leading edge of one blade with the hub but also the longitudinal axis of the propeller and, on the other hand, the junction of the tailing edge of the adjacent blade with the hub, elongate weeds would stick or cling to the surface of the hub in a longitudinal direction with either the one end of the weeds entangling about the motor housing or the other end of the weeds becoming entwined which fouled the propeller. With the little or no gap it has been discovered that the weeds never get a chance to straighten out and stick or cling to the hub. The leading edge of the blades will keep the weeds from adhering to the hub so that the weeds are pushed or propelled radially outward from the hub and are cut or thrust away from the propeller without entanglements or fouling.

Figure 12:
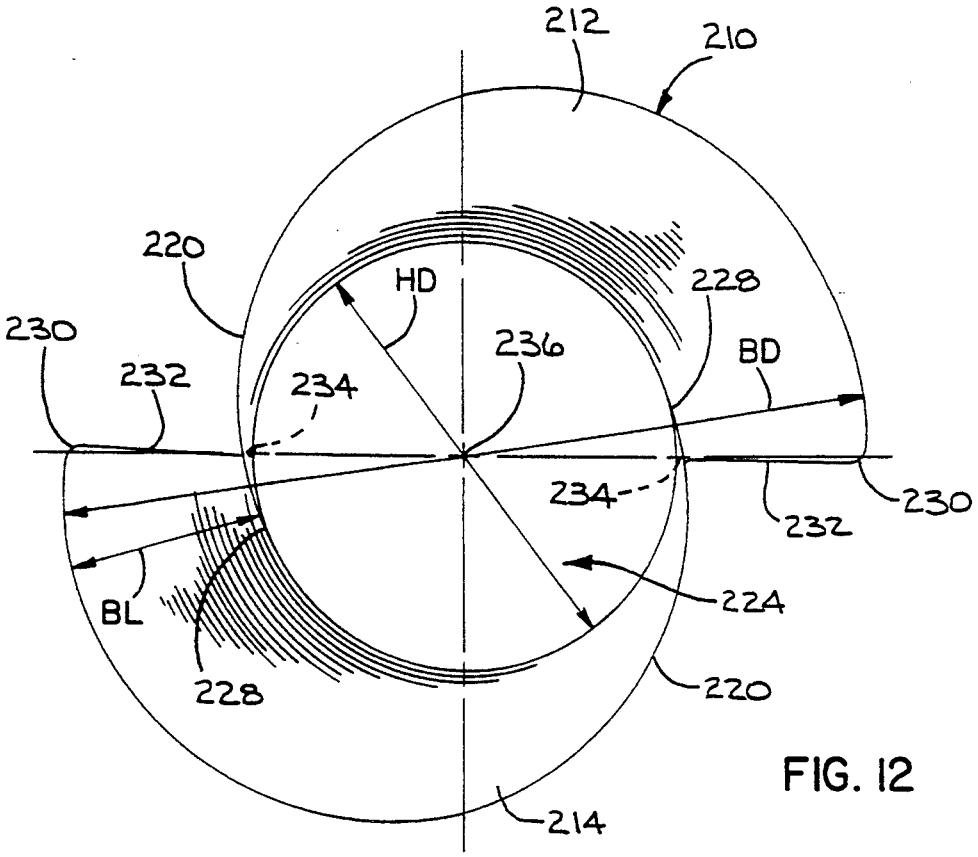
FIG. 12 is a front elevational view of a further modified form of a propeller, looking from the front toward the rear of the propeller.
Figure 13:
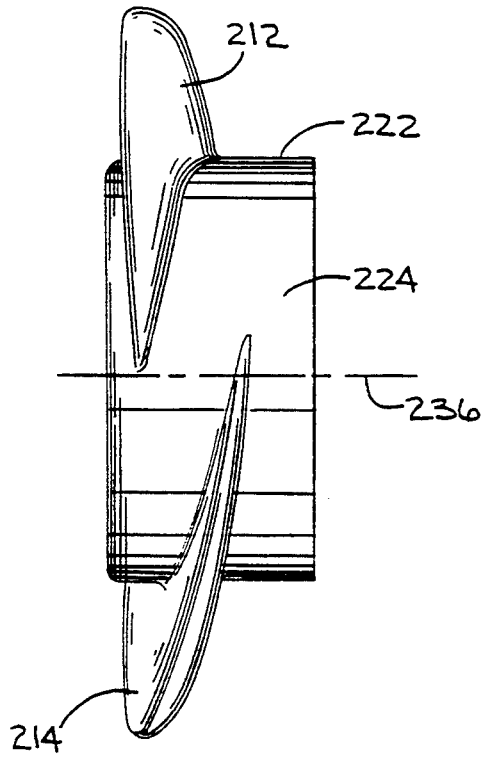
FIG. 13 is a side elevational view of FIG. 12.

FIGS. 12 and 13 show a further modification of our weedless propeller. The propeller 210 comprises a hub 224 having a longitudinal axis 236 and a tubular surface 222. The surface 222 of the hub could be tapered or slightly dome shaped without departing from the spirit of the invention. Two blades 212 and 214 are illustrated as attached to the surface of the hub although it is recognized that three or more blades could be affectively used. The hub 224 has a diameter HD while the propeller 210 has a diameter BD which is the diameter generated when the outermost point on one of the blades 112, 114 is rotated about the axis 236 of the hub. Each blade 112, 114 has a blade length BL which is one half the difference between the blade diameter BD and the hub diameter HD. As has been pointed out hereinabove, the hub diameter HD is greater than or equal to the BL which is one element in creating a weedless propeller. The width W of each blade 112, 114 as measured at the root of the blade where the blade joins the hub is equal to or greater than the blade length BL which has been also found to be a contributing factor in creating a weedless propeller.

The leading edge 220 of each blade 112, 114 forms a smooth junction with the hub at a point 228 with the leading edge gradually falling away from the junction point 228 to an intersection at a corner 230 with the trailing edge 232. Trailing edge 232 intersects with the hub at junction point 234.

It should be noted that the junction 228 of the leading edge 220 of the blade 112 slightly overlaps with the junction 134 of the trailing edge of the next adjacent blade 114 so that the distance S is negative. Due to the overlap between the leading edge 128 of one blade with the trailing edge 134 of the next adjacent blade there is no uninterrupted longitudinally extending surface from the front to the rear of the hub for weeds or the like to stick or cling to the surface of the hub. Without the weeds sticking to the hub, fouling of the propeller is substantially reduced or eliminated altogether.

Using two or more blades on a hub wherein the ratio of the hub diameter to the blade length is in the range of 1.25 to 1 and above and wherein the junction of the trailing edge of one blade overlaps in a longitudinal direction the junction of the leading edge of an adjacent blade with the hub results in a propeller that is substantially weed free when started in a weed infested environment and when operated in and through a heavy weed infested environment. Likewise using two or more blades on a hub wherein the width of each blade at the hub is equal to or greater than the blade length and wherein the junctions of the leading edge of one blade with the hub lies in overlapping relationship with the junction of the trailing edge of the next adjacent blade with the hub when viewed in an axial direction produces a substantially weedfree propeller both at start up and during operation in heavy weed infested water.

The propellers described herein are all for use on low horsepower, i.e. under two horsepower, electric or gas driven trolling motors. Trolling motors of the type herein referred to are undirectionally driven, i.e., driven in one direction only with steering and direction control provided by changing the direction in which the trolling motor is pointed. Turning the trolling motor 180° will change the direction of the boat upon which the trolling motor is mounted form a forward direction to a backward or rearward direction. The propeller incorporating our invention is used on conventional horsepower trolling motors which have been standard in the trade for many years. In the description of our invention when referring to the leading edge of a blade on a propeller it is clearly understood that that connotates that portion of the blade that first contacts the weeds and the water when the trolling motor is driven in its normal intended forward direction.

We claim:

1. In an improved weedless propeller for producing thrust upon rotation by a rotatable shaft within water and having elongate fibrous material therein, the propeller comprising a tubular hub having a hub diameter and an axially extending outer surface, the hub having a longitudinal axis, and at least two blades connected to the hub in circumferentially equally spaced-apart relationship, each of the blades having a blade root with a predetermined width at the outer surface of the hub and a leading blade edge swept back in a direction opposite to the direction of rotation of the propeller, the propeller having a propeller diameter defined by the radially outermost point of the leading edge subscribing a circle having a center at the center of the hub as said propeller is rotated about the longitudinal axis of the hub, and each of the blades having a blade length equal to one-half of the difference between the propeller diameter and the hub diameter, the improvement comprising:

the junction of the leading edge of one blade with the hub is in close proximity with a plane containing the longitudinal axis of the hub and which plane passes through the junction of the trailing edge of the adjacent blade with the hub means, said junction of the leading edge of the one blade with the hub is spaced no greater than 5 degrees from the plane containing the longitudinal axis of the hub and passing through the junction of the trailing edge of the adjacent blade with the hub.

2. The propeller as claimed in claim 1 wherein the ratio of the hub diameter to the blade length is equal to or greater than 1.25 to 1.

3. The propeller as claimed in claim 2 wherein an electric motor drives a shaft upon which the propeller is mounted, the propeller having a pitch measured at substantially 0.7 of the radius of the propeller and wherein said pitch of the propeller is in the range of 2" to 7".

4. In an improved weedless propeller having a tubular hub defining an axis about which the propeller can be rotated to produce thrust within water, said hub having an outer surface with a diameter, first and second blades projecting radially outwardly from said hub, each said first and second blades having a blade root with a predetermined width at the outer surface of the hub and a leading edge swept back in a direction opposite to the direction of rotation of the propeller, the propeller having a diameter defined by the radially outermost point of the leading edge subscribing a circle having a center at the axis of the hub as the propeller is rotated about the hub axis, each said first and second blades having a blade length equal to one-half of the difference between the propeller diameter and the hub outer surface diameter, the improvement comprising:

at least one of said first and second blades having a trailing edge which forms a corner with the swept-back portion of the leading edge, the trailing edge of the one blade intersects the hub at a first point, said corner being located so that a line connecting between the corner and the first point does not pass through the one blade, there being a reference plane passing through the corner and containing the hub axis that divides the propeller into first and second parts with at least a majority of the one blade residing within the first part and a second plane containing the corner and the first point does not intersect the second part of the propeller.

5. The propeller according to claim 4 wherein there are at least three blades projecting radially outwardly from the hub.

6. The propeller according to claim 5 wherein the width of the one blade at its root is at least as large as the length of the one blade.

7. The propeller according to claim 5 wherein the bud surface diameter is at least 1.5 times the length of the one blade.

8. The propeller according to claim 5 wherein the propeller has a pitch measured at 0.7 of the radius thereof and the pitch of the propeller is in the range of 2" to 7".

9. The propeller according to claim 5 wherein the sum of the widths of the blades is greater than the circumference of the hub outer surface.

10. The propeller according to claim 5 wherein the junction of the leading edge of a blade on the hub is adjacent to the point where the trailing edge of the one blade intersects the hub.

11. The propeller according to claim 5 wherein the hub surface diameter is no greater than two times the length of the one blade.

12. The propeller according to claim 4 wherein the trailing edge of the one blade has at least portion thereof that is straight.

13. In an improved weedless propeller for producing thrust upon rotation by a rotatable shaft within water, the propeller comprising a hub having a hub diameter and an axially extending outer surface, the hub having an axis extending longitudinally through the center of the hub and a plurality of blades connected to the hub in circumferentially equally spaced-apart relationship, each of the blades having a blade root with a predetermined width at the outer surface of the hub and a leading blade edge swept back in a direction opposite to the direction of rotation of the propeller, the propeller having a propeller diameter defined by the radially outermost point of the leading edge subscribing a circle having a center at the center of the hub as the propeller is rotated about the longitudinal axis of the hub, and each of the blades having a blade length equal to one-half of the difference between the propeller diameter and the hub diameter, the improvement comprising:

the propeller having four blades uniformly positioned about the hub, and wherein the ratio of the hub diameter to the blade length is equal to a value in the range of at least 1.25 to 1, whereby the propeller has reduced resonance at the hub, has reduced steering instability, and has improved weedlessness, and wherein the four blades have blade lengths which substantially eliminates cavitation of the blades and, in particular, eliminates cavitation at the more diametrically remote portions of each blade, the sum of the width of said four blades being greater than the circumference of the hub, said blades each having a cross-sectional configuration taken transversely to the length of the blades at a radius of 0.7 of the blade radius from the hub axis that is in the shape of a hydrofoil.

14. In an improved weedless propeller having a tubular hub defining an axis about which the propeller can be rotated to produce thrust within water, said hub having an outer surface with a diameter, at least three blades projecting radially outwardly from said hub, each said blades having a blade root with a predetermined width at the outer surface of the hub, a leading edge swept back in a direction opposite to the direction of rotation of the propeller, the propeller having a diameter defined by the radially outermost point of the leading edge subscribing a circle having a center at the axis of the hub as the propeller is rotated about the hub axis, each said blades having a blade length equal to one-half of the difference between the propeller diameter and the hub outer surface diameter, the improvement comprising:

said blades each having a length that is less than the width of the blade, said blades having a pitch measured at 0.7 of the radius of the propeller from the hub axis and wherein the pitch of the blades is 2–7 inches.

15. The improved weedless propeller according to claim 14 wherein said blades have a cross-sectional configuration taken transversely to the length of the blades at a radius of 0.7 of the blade radius from the hub axis that is in the shape of a hydrofoil.

16. In an improved weedless propeller having a tubular hub defining an axis about which the propeller can be rotated to produce thrust within water, said hub having an outer surface with a diameter, at least three blades projecting radially outwardly from said hub, each said blades having a blade root with a predetermined width at the outer surface of the hub and a leading edge swept back in a direction opposite to the direction of rotation of the propeller, the propeller having a diameter defined by the radially outermost point of the leading edge subscribing a circle having a center at the axis of the hub as the propeller is rotated about the hub axis, each said blades having a blade length equal to one-half of the difference between the propeller diameter and the hub, outer surface diameter, the improvement comprising:

said blades each having a length that is less than the diameter of the hub, said blades having a pitch measured at 0.7 of the radius of the propeller from the hub axis and wherein the pitch of the blades is 2–7 inches.

17. The improved weedless propeller according to claim 16 wherein the ratio of the hub diameter to the blade length is at least 1.250 to 1.

18. The improved weedless propeller according to claim 16 wherein the ratio of the hub diameter to the blade length is no more than 2 to 1.

19. The improved weedless propeller according to claim 16 wherein the length of the blades is less than the width of the blades.

* * * * *